US007008505B2

(12) United States Patent
Akhtar et al.

(10) Patent No.: US 7,008,505 B2
(45) Date of Patent: Mar. 7, 2006

(54) EUCALYPTUS BIOMECHANICAL PULPING PROCESS

(75) Inventors: Masood Akhtar, Madison, WI (US); Eric G. Horn, Madison, WI (US); Michael J. Lentz, Madison, WI (US); Ross E. Swaney, Madison, WI (US)

(73) Assignee: Biopulping International, Inc., Madison, WI (US)

( * ) Notice: Subject to any disclaimer, the term of this patent is extended or adjusted under 35 U.S.C. 154(b) by 0 days.

(21) Appl. No.: 10/478,941

(22) PCT Filed: May 30, 2002

(86) PCT No.: PCT/US02/16889

§ 371 (c)(1),
(2), (4) Date: Nov. 26, 2003

(87) PCT Pub. No.: WO02/099183

PCT Pub. Date: Dec. 12, 2002

(65) Prior Publication Data

US 2004/0154762 A1 Aug. 12, 2004

Related U.S. Application Data

(60) Provisional application No. 60/295,454, filed on Jun. 1, 2001.

(51) Int. Cl.
*D21B 1/16* (2006.01)

(52) U.S. Cl. ..... 162/25; 162/26; 162/9; 162/23; 162/72; 162/91; 435/277; 435/278

(58) Field of Classification Search ..... 162/25, 162/26, 9, 72, 91, 23; 435/277, 278
See application file for complete search history.

(56) References Cited

U.S. PATENT DOCUMENTS

| | | | | |
|---|---|---|---|---|
| 1,138,907 | A | 5/1915 | Thickens | |
| 1,873,056 | A | 8/1932 | Smith et al. | |
| 2,528,350 | A | 10/1950 | Farber | |
| 3,962,033 | A | 6/1976 | Eriksson et al. | |
| 4,225,381 | A | 9/1980 | Ishikawa et al. | |
| 4,451,331 | A | 5/1984 | Raggam et al. | |
| 4,576,609 | A | 3/1986 | Hageman | |
| 4,599,138 | A * | 7/1986 | Lindahl | 162/19 |
| 4,655,926 | A | 4/1987 | Chang et al. | |
| 5,055,159 | A | 10/1991 | Blanchette et al. | |
| 5,066,232 | A | 11/1991 | Negri et al. | |
| 5,196,069 | A | 3/1993 | Cullingford et al. | |
| 5,223,090 | A | 6/1993 | Klungness | |
| 5,460,697 | A | 10/1995 | Akhtar et al. | |
| 5,607,855 | A | 3/1997 | Zimmerman et al. | |
| 5,620,564 | A | 4/1997 | Akhtar | |
| 5,705,383 | A | 1/1998 | Blanchette et al. | |
| 5,711,945 | A | 1/1998 | Blanchette et al. | |
| 5,750,005 | A | 5/1998 | Akhtar et al. | |
| 5,766,926 | A | 6/1998 | Blanchette et al. | |
| 5,851,351 | A | 12/1998 | Baecker et al. | |
| 5,853,534 | A | 12/1998 | Hoglund et al. | |
| 5,865,949 | A | 2/1999 | Pere et al. | |
| 6,406,592 | B1 * | 6/2002 | Leskela et al. | 162/142 |
| 6,613,192 | B1 | 9/2003 | Bajpai et al. | |

FOREIGN PATENT DOCUMENTS

| | | | |
|---|---|---|---|
| GB | 469300 | | 7/1937 |
| WO | WO 96/05362 | A1 | 2/1996 |
| WO | WO 98/42914 | | 10/1998 |
| WO | WO 99/46444 | * | 9/1999 |
| WO | WO 99/57239 | | 11/1999 |
| WO | WO 02/075043 | | 9/2002 |

OTHER PUBLICATIONS

Akhtar, M., Attridge, M.C., Myers, G.C. and Blanchette, R.A. "Biomechanical Pulping of Loblolly Pine Chips with Selected White-Rot Fungi", *Holzforschung*, 1993, 47(1), 36-40.

Akhtar, M., et al., "The White-Rot Fungus *Ceriporiopsis subvermispora* Saves Electrical Energy and Improves Strength Properties During Biomechanical Pulping of Wood", *Proceedings of the 5th International Conference on Biotechnology in the Pulp and Paper Industry*, Kyoto Japan, May 27-30, 1992, p. 3-8.

Akhtar, M., et al., "Toward Commercialization of Biopulping", *PaperAge*, Feb. 1999, p. 1-4.

Akhtar, et al., "Biomechanical Pulping of Loblolly Pine With Different Strains of the White-Rot Fungus *Ceriporiopsis subvermispora*", *Tappi J.*, Feb. 1992, pp. 105-109.

Ander, P. and Eriksson, K.E. "Mekanisk massa från förrötad flis—en inledande undersökning", *Svensk Papperstidning*, 1975, 18, 641.

Bar-Lev, et al., "Fungal Treatment Can Reduce Energy Requirements for Secondary Refining of TMP", *Tappi J.*, Oct. 1982, pp. 111-113.

Blanchette, R., "Screening Wood Decayed by White Rot Fungi for Preferential Lignin Degradation", *Applied and Environmental Microbiology*, Sep. 1984, pp. 647-653.

(Continued)

*Primary Examiner*—Mark Halpern
(74) *Attorney, Agent, or Firm*—Michael Best & Friedrich LLP; Jeffrey D. Peterson

(57) ABSTRACT

In a new process for preparing pulped wood chips for paper making, chips from a hardwood such as eucalyptus are inoculated with aliving culture of one or more white rot fungi. The fungi propagate throughout the body of the wood chip, selectively attacking the lignin of the wood without harming the cellulosic fibers. Subsequent mechanical pulpting results in reduced utilization of energy, improved strength, and reduced cooking time.

22 Claims, No Drawings

OTHER PUBLICATIONS

Blanchette, R.A. and Burnes, T.A., "Selection of White-Rot Fungi for Biopulping", *Biomass*, 1988, 15, 93-101.
Bosman, J.L., et al., In FEMS Symposium, Lignin Biodegradation and Transformation, Book of Proceedings 1993, Forbitec Editions, Lisboa, pp. 39-40.
Eriksson, K.E. and Vallander, L., "Properties of Pulps from Thermomechanical Pulping of Chips Pretreated with Fungi", *Svensk Paperstidning*, 1982, 85(6), R33-R38.
Eriksson, K.E., et al., "A Scanning Electron Microscopy Study of the Growth and Attack on Wood by Three White-Rot Fungi and Their Cellulase-less Mutants," *Holzforschung*, 34, 207-213.
Kirk, T.K. et al., "Potential Applications of Bio-Ligninolytic Systems," *Enzyme Microb. Technol.*1981, 3:189-196.
Labosky Jr., P., Zhang, J. and Royse, D.J., "Lignin Biodegradation of Nitrogen Supplemented Red Oak (*Quercus Rubra*) Wood Chips with Two Strains of *Phanerochaete chrysosporium", Wood and Fiber Sci.*, 1991, 23, 533-542.
Lamar, R.T. et al., "In Situ Depletion of Pentachlorophenol from Contaminated Soil by *Phanerochaete* Spp., " *App. Enviro. Micro.*, 1990, vol. 56 No. 10, pp. 3093-3100.
Lawson, L. and Still, C., "The Biological Decomposition of Lignin—Literature Survey", *Tappi J.*, vol. 40 No. 9, Sep. 1957, pp. 56A-80A.
Leatham, et al., "Energy Savings in Biomechanical Pulping", *4th International Conference*, Raleigh, NC, May 16-19, 1989.
Leatham, et al., "Biomechanical Pulping of Aspen Chips: Paper Strength and Optical Properties Resulting from Different Fungal Treatments", *Tappi J.*, Mar. 1990, pp. 249-255.
Leatham, et al., "Biomechanical Pulping of Aspen Chips: Energy Savings Resulting from Different Fungal Treatments", *Tappi J.*, May 1990, pp. 197-200.
Messner, K., Masek, S., Srebotnik, E. and Techt, G., "Fungal Pretreatment of Wood Chips for Chemical Pulping", *Biotechnology in the Pulp and Paper Industry, Proceedings of the 5th International Conference on Biotechnology in the Pulp and Paper Industry* (Kuwahara, M. and Shimada, M., eds.) 1992, pp. 9-13.
Myers, et al., "Fungal Pretreatment of Aspen Chips Improves Strength of Refiner Mecahnical Pulp", *Tappi J.*, May 1988, pp. 105-108.
Oriaran, et al., "Kraft Pulp and Papermaking Properties of *Phanerochaete chrysosporium*-degraded Aspen", *Tappi J.*, Jul. 1990, pp. 147-152.
Oriaran, T. Ph., Labosky Jr., P. and Blankenhorn, P.R., "Kraft Pulp and Papermaking Properties of *Phanerochaete chrysosporium* Degraded Red Oak", *Wood and Fiber Sci.*, 1991, 23, 316-327.
Scott, G.M., Akhtar, M., Lentz, M., Sykes, M. and Abubakr, S., "Biosulfite Pulping Using *Ceriporiopsis subvermispora*", (Srebotnik, E., Messner, K. eds.), Facultas-Universitats Verlag, Bergasse 5, A-1090 Wien, Austria, 1996, p. 217-219.
Scott, G.M., Akhtar, M., Lentz, M., Sykes, M., and Abukar, S. 1995. In *Proceedings of the 1995 Environmental Conference*, pp. 1155-1161, Atlanta: Tappi Press.
Wolfaardt, J.F., Boshoff, I.E., Bosman, J.L., Rabie, C.J. and van der Westhuizen, G.C.A., "Lignin Degrading Potential of South African Wood-Decay Fungi", *FEMS Symposium, Lignin Biodegradation and Transformation, Book of Proceedings* (Duarte, J.C., Ferreira, M.C. and Ander, P., Eds.), Forbitec Editions, Lisboa. 1993, pp. 67-68.
Wolfaardt, J.F., Bosman, J.L., Jacobs, A., Male, J.R. and Rabie, C.J., "Bio-Kraft Pulping of Softwood", *Proceedings of the 6th International Conference on Biotechnology in the Pulp and Paper Industry: Advances in Applied and Fundamental Research* (Srebotnik, E., Messner, K. eds.), Facultas-Universitats Verlag, Bergasse 5, A-1090 Wien, Austria, 1996, p. 211-216.
Yang, et al. "Bleaching of Softwood Kraft Pulps with the EnZone Process", *Tappi J.*, vol. 77 No. 3, See Abstract, Mar. 1994, pp. 243-250.
Yang, J.L., et al. "Bleaching of Eucalyptus Kraft Pulp with the EnZone Process," *Tappi Journal*, 1993, 76:7:91-96.
Akhtar et al., "Fungal Delignification and Biomechanical Pulping of Wood," *Advances in Biochemical Engineering/Biotechnology* (1997) 57:160-195.
Borralho et al., "Breeding Objectives for Pulp Production of *Eucalyptus globulus* Under Different Industrial Cost Structures," *Can. J. For.* (1992) 23:648-656.
Conrad P. "Urban Wood Markets in the Northwest," *BioCycle* (1995) 36:11:70-72.
Davis et al. "Microwave-Assisted Solvent Pulping," *Holzforschung* (1991) 45:71-77.
Griffith et al., "Microwave Pretreatment of Wood," National Meeting of the American Institute of Chemical Engineers, Spring 2000 Presentation.
Forest Products Project Fact Sheet, "Increasing Yield and Quality of Low-Temperature, Low-Alkali Kraft Cooks with Microwave Pretreatment," (2001) 1-2.
"International Fact & Price Book 2002," Pulp & Paper International, San Francisco, CA.
Jameel et al., "Microwaving of Logs to Increase Yield and Decrease Chemical Usage," TAPPI Pulping Conference, Seattle, WA (2001).
Jefferies & Vilkara eds., Enzymes for Pulp and Paper Processing, *American Chemical Society*, Washington, D.C. (1997).
Jones et al., "The Potential for Biological Control of Bluestain in Britain," ICPP98 Paper No. 5.2.83, pp. 1-2.
Pearce et al., "Screening Lignin Degrading Fungi for Biomechanical Pulping of Eucalypt Wood Chips," Proceedings 49th Appita Annual General Conference, Hobart Tasmania, Australia, Apr. 2-7, 1995.
Woodbridge, Reed & Associates. World Market Pulp Demand with Special Reference to Eucalyptus, *Canada Alberta* (1986).

* cited by examiner

EUCALYPTUS BIOMECHANICAL PULPING PROCESS

CROSS-REFERENCE TO RELATED APPLICATIONS

This application is a 371 of PCT/US02/16889 filed 30 May 2002, which claims benefit of application 60/295,454 filed 1 Jun. 2001.

STATEMENT REGARDING FEDERALLY SPONSORED RESEARCH OR DEVELOPMENT

Not applicable.

BACKGROUND OF THE INVENTION

In the manufacture of paper from wood, the wood is first reduced to an intermediate stage in which the wood fibers are separated from their natural environment and transformed into a viscous liquid suspension known as a pulp. There are several classes of techniques which are known, and in general commercial use, for the production of pulp from various types of wood. The simplest in concept of these techniques is the so-called refiner mechanical pulping (RMP) method, in which the input wood is simply ground or abraded in water through a mechanical milling operation until the fibers are of a defined desired state of freeness from each other. Other pulping methodologies include thermo-mechanical pulping (TMP), chemical treatment with thermo-mechanical pulping (CTMP), chemi-mechanical pulping (CMP) and the so-called kraft or sulfate process for pulping wood. In all of these processes for creating pulps from wood, the concept is to separate the wood fibers to a desired level of freeness from the complex matrix in which they are embedded in the native wood.

Of the constituents of wood as it exists in its native state, the cellulose polymers are the predominate molecule which is desired for retention in the pulp for paper production. The second most abundant polymer to cellulose in the native wood, which is the least desirable component in the pulp, is known as lignin. Lignin is a complex macromolecule of aromatic units with several different types of interunit linkages. In the native wood, lignin physically protects the cellulose polysaccharides in complexes known as lignocellulosics, and those lignocellulosics must be disrupted for there to be marked enzyme accessibility to the polysaccharides, or to separate lignin from the matrix of the wood fibers.

It has been suggested that biological systems can be utilized to assist in the pulping of wood. A desirable biological system would be one which is intended to liberate cellulose fibers from the lignin matrix by taking advantage of the natural abilities of a biological organism. Research in this area has focused on a type of fungi referred to as white-rot wood decay fungi. These fungi are referred to as white-rot, since the characteristic appearance of wood infected by these fungi is a pale color, which color is the result of the depletion of lignin in the wood, the lignin having been degraded or modified by the fungi. Since the fungi appear to preferentially degrade or modify lignin, they make a logical choice for fungi to be utilized in biological treatments to pulp wood, referred to as biopulping.

Several reports have been made of attempts to create biopulping systems using white-rot fungi on a variety of wood fibers. Previous research has concentrated on a single, or relatively few, species of fungi. The most commonly utilized fungi in such prior systems is the white-rot fungi *Phanerochaete chrysosporium*, also referred to as *Sporotrichum pulverulentum*. Other fungi which have been previously used in such procedures include fungi of the genera Polyporus and Phlebia. The prior art is generally cognizant of the fact that attempts have been made to use biological organisms, such as white-rot fungi, as part of a process of treating wood, in combination with a step of either mechanical or thermal mechanical pulping of cellulose fiber.

The use of white rot fungi for the biological delignification of wood was studied as early as the 1950s at the West Virginia Pulp and Paper Company (now Westvaco) (Lawson and Still, C. N. (1957) *Tappi J.,* 40, 56A–80A). In the 1970s Eriksson and coworkers at STFI (Swedish Forest Product Laboratory) demonstrated that fungal treatment could result in significant energy savings for mechanical pulping (U.S. Pat. No. 3,962,033 for an invention by Eriksson et al. (1976); (Ander and Eriksson, K. E., (1975); *Svensk Papperstidning,* 18, 641) (Eriksson and Vallander, K. E. (1982) *Svensk Paperstidning,* 85(6), R33–R38). Two sequential biopulping consortia comprised of the USDA Forest Service, Forest Products Laboratory in Madison, Wis. (hereinafter, "FPL"), the Universities of Wisconsin and Minnesota, and 22 pulp and paper and allied companies demonstrated the techno-economic feasibility of biopulping in connection with mechanical refining (Akhtar et al., (1992a), *Tappi J.,* 75(2), 105–109); (Akhtar et al., (1992b) *Biotechnology in the pulp and paper industry*, (Kuwahara, M. and Shimada, M. eds.) Tokyo, UNI Publishers Company Ltd., p. 545); (Akhtar et al., (1993) *Holzorschung,* 47(1), 36–40); (Blanchette, R., (1984) *Applied & Environmental Microbiology,* 48(3), 647–653); (Blanchette et al., (1988) *Biomass,* 15, 93–101); Leatham et al.(1989) *Biotechnology in the Pulp and Paper Industry, 4th International Symposium*, Raleigh, N.C., May 16–19); (Leatham et al., (1990a), *Tappi J.,* 73(3), 249–255); Leatham et al., (1990b), *Tappi J.,* 73(5), 197–200), (Myers et al., (1988), *Tappi J.,* 71(5), 105–108); (Pearce, N. H., et aL) screened 204 isolates of wood decay fungi in bench scale trials for their performance in biomechanical pulping of eucalyptus chips. (*Proccedings* 49th *Appita Annual General Conference*, Hobart, Tasmania, Australia, 2–7 Apr. 1995, 347–351) Refining energy savings of 40%–50% were obtained with some selected fungi. No strength improvements were reported. Additional developments in biomechanical pulping were described in: U.S. Pat. No. 5,055,159 for an invention by Blanchette, et al. (1991); U.S. Pat. No. 5,460,697 for an invention by Akhtar et aL (1995); U.S. application published as WO 9605362 on Feb. 1, 1996.

Unfortunately, biomechanical processes have only gained limited commercial acceptance, and have not been widely utilized. One of the difficulties has been that most of the prior techniques for utilizing biological techniques for the pulping of paper have resulted in paper which has had only marginal strength increase or is weaker than papers made by more conventional processes.

In fact, while a certain amount is known about the interaction of lignin and cellulose in wood fibers, because of the extreme complexity of the relationships, and the variation in the enzymes produced by varieties of the white-rot fungi, it is not readily possible to predict from the action of a given fungus on a given type of wood whether or not the paper made from wood partially digested with such fungus will have desirable qualities or not. The selection of white-rot fungi for biopulping applications on the basis of selective lignin degradation may seem a rational one, but it has proven to be a poor predictor of the quality of the resultant paper.

The exact relationship between the degradation of lignin, and the resulting desirable qualities of paper produced at the end of the pulping process, are not at all clear. Accordingly, given present standards of technology and the present understanding of the complex interaction of lignin and cellulose, it is only possible to determine empirically the quality of paper produced through a given biological pulping process and the amount of any energy savings achieved through such a process.

For reasons set forth above, most of the fungi screened for the biomechanical pulping of one type of wood do not necessarily work well in the biomechanical pulping of another type of wood. All the biomechancial pulping references described above are directed to the biopulping and processing of wood species other than eucalyptus, a very common wood species in many parts of the world and potentially valuable source of pulp for papermaking or other processes. What is needed is a method of processing eucalyptus wood which takes advantage of the cost savings of mechanical pulping techniques without a loss of end product quality one often experiences when using mechanical pulping.

SUMMARY OF THE INVENTION

In the method of the present invention, eucalyptus wood is partially degraded with a culture of the fungus *Ceriporiopsis subvermispora*, followed by mechanical pulping of the treated wood.

It has been found that through the biological degradation of eucalyptus chips using *Ceriporiopsis subvermispora* followed by mechanical pulping of the treated wood chips, a dramatic decrease in the energy required for mechanical pulping is achieved while at the same time giving rise to paper which has enhanced, rather than decreased, strength characteristics.

It is thus an advantage of the process described in accordance with the present invention that a procedure for the biomechanical pulping of eucalyptus wood chips is described which utilizes less energy than prior art techniques and which results in paper having more desirable strength characteristics.

It is further an object of the present invention in that it utilizes a natural biological organism to degrade the wood thus reducing the likelihood of unwanted artificial environmental contaminants produced by degradation of lignin and its byproducts.

It is a further advantage of the present invention in that it has been found that the biological processing of the wood chips in accordance with the present invention can be done in a static fermentation procedure without the need for an exotic or moving fermenting chamber thereby allowing the process to be used more practically on a large scale.

Other objects, advantages, and features of the present invention will become apparent from the detailed description of the invention, below.

DETAILED DESCRIPTION OF THE INVENTION

The present invention is directed toward the biological pretreatment of wood chips for pulp making for paper manufacture. It has been particularly found here that through the use of a particular species of fungus, and the maintenance of relatively forgiving conditions during the treatment of wood chips by said fungus, it is possible to utilize a biological treatment or pretreatment as a part of a process of pulping eucalyptus wood, a wood resource of high commercial importance in many parts of the World. It has further been found that the pulping process results in a paper which has a strength which is increased over paper made from eucalyptus wood by purely mechanical pulping and over paper made from other species of wood by biomechanical pulping. It has been found, furthermore, that the eucalyptus biomechanical pulping method of the present invention results in a dramatic savings in the energy expended during the mechanical pulping process. In other words, the process of biomechanical pulping of eucalyptus wood of the present invention not only results in energy savings; it also results in a stronger product.

This process of the present invention makes use of white rot fungi, preferably, a culture of *C. subvermispora*, more preferably a culture of *C. subvermispora* L-14807-SS-3. However, other white rot fungi can also be used. Strains of *C. subvermispora* can be maintained by conventional fungal culture techniques most conveniently by growing on potato-dextrose-agar (PDA) slants. Stock slants may routinely be prepared from an original culture for routine use and may be refrigerated until used. The particular strain of *C. subvermispora* utilized in the examples below, L-14807-SS-3 was obtained from the Center for Mycology Research, Forest Products Laboratory, Madison, Wis. It was found that particular strain of fungus was particularly well-suited for biomechanical pulping of eucalyptus wood, according to the process of the present invention. However, other it is contemplated that other strains of *C. Subvermispora*, such as—CZ-3, L-9186-SP, FP-105732, and FP-105752-SS5, and other white rot fungi, such as *Hyphodontia setulosa, Phlebia subserialis, Phlebia brevispora, Phlebia tremellosa, Phanerochaete chrysosporium* would be suitable for use in the methods of the present invention.

The process of the present invention is intended for and particularly adapted for the biopulping of eucalyptus. The wood is converted to chips through a conventional technology. Wood chips are heat treated, preferably with steam, to disable but not necessarily sterilize the chips prior to inoculation with the fungus. The moisture content in the chips is kept at fiber saturation point or greater. A preferred moisture content would be approximately 50–55% of the total wood based on wet weight basis of the chips.

Fungi are preferably applied to the wood as follows. To inoculate significant volumes of wood chips, a starter inoculum may be prepared. PDA plates are inoculated from PDA slants and incubated at 27±1° C. and 70–90% relative humidity. These plates are used to inoculate 1 liter Erlenmeyer flasks containing potato dextrose broth and yeast extract. The inoculated flasks are incubated without agitation in an incubator at 27±1° C. and 70–90% relative humidity for 7–10 days. The surface of the medium is covered with the fungus in the form of mat. The fungal mat is removed from the medium, washed with sterilized water on sterilized buchner funnel to remove all the medium. The fungal mat is transferred into a sterile waring blender with sterile forceps and blended with sterile water. This suspension is used to inoculate wood chips. Scaling up the foregoing culture steps for preparing the fungal inoculation involves preparation of media in commercial scale vats, and growth of fungi in commercial scale fermenters. Using industrial scale equipment, fungal cultures in 500–1500 gallon batches are readily obtainable.

Fungal treatment of wood chips is carried in bioreactor which may be any of a number of styles capable of handling solid media fermentation culture. It is merely required that the stationary or solid phase reactor have sufficient aeration so as to ensure adequate $O_2$ flow to the fungus and significant removal of $CO_2$ therefrom. In fact, it is an advantage of the process that it can be conducted in static fermentation procedure without the need for an exotic or moving fermenting chamber thereby allowing the process to be used more practically on a large scale. Aeration, humidity and temperature are all preferably controlled, to at least some extent. On an industrial scale, the inoculated chip mass may be incubated in cylindrical silos or in open chip piles of 20–200 tons, under nonstick conditions, provided proper ventilation is maintained, as discussed more fully hereafter.

For the fungal treatment, wood chips are put in the bioreactor, autoclaved and cooled to room temperature, or exposed to steam to disable native microorganism populations without absolute sterilization. The wood chips to be treated are inoculated with starter culture. The amount of inoculum added to the chips can vary. It should be sufficient to ensure growth and spread to all chips in the bioreactor. Inoculum level of 1 to 5 gm per ton of wood chips was found to be sufficient. The chips so inoculated will then be incubated during a time period in which the fungal mycelia will penetrate throughout the wood chips. It has been found that nutrients are not required during fungal treatment of eucalyptus wood chips. Addition of nutrients does not give additional biopulping benefits but result in more loss in the weight of wood chips and unbleached pulp yield. The most desired temperature range depends on the fungal strains.

It has been found that a bioreactor kept in the range of 27±2° C. with a moisture content in the wood of 55–65% achieves a great degree of mycelia penetration of wood chips that results in significant degradation of wood chips for paper pulping process. The wood chips are aerated continuously during the incubation period with the air saturated with moisture that the wood maintains the constant moisture content of about 55–65%. It has been found that under the conditions used experimentally, an incubation period of 1 to 3 weeks results in significant modification of the wood chips and reduction in energy output for mechanical processing in the subsequent processing steps.

The biologically degraded wood chips are then subjected to a mechanical pulping process. Eucalyptus pulp made according to the biomechanical pulping procedure of the present method can then be bleached in a multistage bleaching process and made into paper using standard papermaking techniques. Paper made from eucalyptus biomechanical pulp is better in quality, strength and texture to that created from eucalyputs through a simple mechanical pulping process and to that created from other woods through either simple mechanical or biomechanical pulping processes.

Effective biopulping can be carried out under nonsterile conditions in which naturally occurring flora are present and viable. However, better results are obtained with steamed or autoclaved wood chips. Eucalyptus wood chips are exposed to live steam resulting in elevating their surface temperature to about 90° to 100° C., as measured immediately after steam treatment. The exposure time is a function of the temperature of the superheated vapor and also the inlet pressure. While 101° to 108° C. influent steam at 15 to 75 in line psi for exposure times of 3 to 50 seconds is adequate, the optimum values are best determined in a few empirical process runs for the particular type and configuration of equipment, as hereinafter described in more detail.

The chamber in which steam treatment takes place should not be too tightly packed. Open space of about under 10% to over 65% of the volume capacity is sufficient to allow penetration of steam to all chip surfaces provided that the chips can be mechanically turned or agitated to prevent impeded exposure to steam at touching surfaces. For example, in the screw conveyor used in a preferred embodiment of the invention, the open space above the chips in the conveyor was found to be approximately 57% to 69%. In addition, the void space between the chips in the preferred embodiment amounted to approximately 61%. Therefore, the total void space in the conveyor amounted to approximately 83% (large chips) to 88% (small chips). Uniformity of steam treatment is very important, as the naturally occurring flora must be uniformly disabled or biosuppressed physiologically to avoid spots of overgrowth by contaminants during the subsequent incubation step.

A particularly efficient method of steam treatment is by injecting steam into a continuous flow screw or auger bearing the chips at about 30% to 45% spacial density as discussed above. It was found that exposure time of chips adequate for the present process could be only 40 seconds compared to 5–10 minutes in a quiescent batch mode. Steam was released at moderate pressure and applied ambiently without pressurizing the vessel.

A number of species of contaminating organisms can readily be isolated from moistened wood chips including *Aspergillis* spp., *Colletotrichum* spp., *Trichoderma* spp., *Gliocladium* spp., *Ophiostoma* spp., *Penicillium* spp., *Ceratocystis* spp., *Nectria* spp., *Cytospora* spp., and *Alternaria* spp. Many of these are more physiologically robust and faster growing than the inoculating lignin-degrading or modifying fungi of choice. Growth of these organisms is also enhanced in many instances by the nutrient adjuvants contained in the fungal inoculum. Therefore, addition of such nutrients is avoided.

Once the indigenous, undesirable microbes are disabled or suppressed by steam treatment, the less robust and more fastidious white-rot fungi in the inoculum are able to remain dominant over extended periods. The disabled organisms are still viable and capable of becoming dominant, as shown by biopulping runs in which the treatment temperature was inadvertently allowed to rise only to sub-optimal levels. In those instances the runs were ruined by overgrowth of the contaminating fungi. Clearly a highly delicate but controllable process balance must be maintained, but it is unclear scientifically what competitive factors are at work to maintain the desired biological balance over extended incubations. Reducing exposure to steam to a minimum without sterilization also has favorable implications for process costs. The low exposure time conductive to a continuous treatment means that high volume treatment required in any commercial scale process is attainable in the present invention.

If steam or heat is used to sterilize the wood chips, the chips are preferably cooled prior to inoculation of the biopulping fungi to minimize the possiblity of killing or disabling the organisms in the inoculum. Chips steam treated on a continuously moving path are passed through heat transfer means which cool the chips to an appropriate temperature for inoculation. Applicants have found that the most cost effective and simplest method is to place an in-line air blower manifold directly in the conveyance path, and adjust the air flow to a rate that will cool the passing chips adequately.

Chips to be inoculated with *Ceriporiopsis subvermispora* L14807 SS-3 are preferably cooled to no more than about 50° C., more preferably to a temperature between about 40° C. and about 45° C. The highest temperature tolerated by biopulping organisms will vary from species to species or even from strain to strain of the same species, so that empirical tests may be necessary to determine a physiologically suitable temperature for inoculation of wood chips with any given type of culture. Cooling only to the highest physiologically suitable temperature minimizes the cooling time and speeds the process, and reduces the energy consumed.

Inoculation of the biopulping fungi is preferably carried out in-line, and applied as a liquid spray to the passing wood chips. As in the steam treatment, the working action of agitated conveyor or auger allows inoculum to be uniformly adsorbed onto the chip surfaces by tumbling and churning during rotary or other agitated conveyance. It is important that the inoculum be applied substantially thoroughly and uniformly to the chip surfaces. If the biopulping fungi are to maintain dominance over other flora, the contaminating flora should not be given a sufficient opportunity to reestablish themselves in local areas of the chip surfaces where coverage of inoculum is uneven.

The enzymatic breakdown or modification of lignin by fungi is an exothermic reaction, so that when a large mass of chips is undergoing delignification, a substantial concentration of heat ensues. As the surface area of the mass of chips diminishes relative to the total mass, the problem intensifies since wood itself is an excellent heat insulator. The most practical way to dissipate heat in the chips to prevent the temperature from exceeding the level at which the biopulping fungi are killed, and the contaminants begin to overgrow the fungi, is by forcing air through the chips.

It has been found that the temperature of chip piles can be adequately controlled and maintained at levels biocompatible with the continued propagation and dominance of the fungus by loading the chips onto an air pervious frame defining a plurality of ducts through which forced air is passed. It has been empirically determined that the humidity of the air should be in a range from at least 30% up to over 95% relative humidity, preferably about 85%, and the flow rate should be adjusted seasonally to maintain the temperature in the core of the pile within the active growth range of the fungus, which must be determined for each species. In the case of *C. subvermispora*, the range is approximately 27° to 32° C.

After inoculation, the chips may be conveniently collected in large piles. Temperature and humidity control are important for optimal fungal propagation and lignin degradation or modification. It has been determined that practical control can be maintained for piles loaded onto the bottom frame referred to above having dimensions about 40–55 feet high, 100 feet wide and any length. Two 400 foot long piles can accommodate a pulp plant utilizing 600 tons of chips daily. To obtain proper humidity, wet bulb/dry bulb tests can be performed on the influent air. Relative humidity should preferably be maintained at about 70%–90%. Humidification of air by conventional means such as fogging prior to pumping or fanning into the frame ducts is generally necessary. The amount of heat generated in the pile generally requires continuous dissipation by forced air flow even during the winter months in the northern climes.

Incubation times are related to the degree of lignin digestion or modification desired, the type of wood chips being handled, and the particular fungus or combination of fungi being utilized in the process. Useful periods of incubation range from a few days to four weeks. On the other hand, prolonged incubation results in larger standing inventories of chips and larger on site storage capacity.

Tubular reactors (silo reactors) can also be used for biopulping. This silo reactor has a large-scale (multiton) capacity. A perforated plate at the bottom of the reactor supports the chips approximately 5 cm above the bottom of the reactor. Air is supplied to this void space at the bottom center of the reactor. A baffle plate immediately above the air inlet distributes the air more evenly across the bottom of the reactor.

After the incubation of the fungi in the wood chips, the wood chips are then preferably subjected to a conventional mechanical refining process to make wood pulp of the desired level of freeness. Dilution water is added to the chips and the chips are run through a mechanical refiner through a number of passes. The number of passes of the chips/pulp mixture will depend upon the freeness desired for the particular paper application to be made. The chip/pulp mixture is fed through the refiner until the desired level of freeness is achieved. Thus freeness may be periodically monitored to determine the progress of the pulps toward the freeness level which is desired for the paper. Between passes the wood pulp may be dewatered as necessary.

The biomechanical pulps made through this procedure may then be made into paper using standard paper making techniques. It has been found that the standard techniques as described by the Technical Association of the Paper and Pulp Industry (TAPPI) which are known to work with mechanically refined pulps work equally well with the biomechanically refined pulps of the type created by the process described herein. Accordingly, the paper may be made in conventional methodologies. The paper from the biomechanically created pulp can be compared in quality, strength and texture to that created through simple mechanical pulping and it will be found that the biomechanically created pulp has significantly increased strength properties. Thus it is apparent that the process of the present invention does not sacrifice the quality or strength of the paper in order to achieve the highly desirable energy savings, but in fact results in a unique combination of both significant reduction in energy utilization in the process, and an increase in the strength properties of the resulting paper.

Biomechanical pulping of eucalyptus wood according to the process of the present invention produces paper of surprisingly high quality compared to previous studies with other woods. In previous studies, we have seen some improvements in paper strength properties during biomechanical pulping of both hardwood and softwood species with several white-rot fungi (U.S. Pat. No. 5,750,005 "Method of Enhancing Biopulping Efficacy," Akhtar (1998)). For example, improvements were observed in burst index of up to 37% and tear index of up to 44% (see Table 1, below) with pine chips (softwood chips), and in tear index of up to 24% (see Table 2, below) with aspen chips (hardwood chips) processed by biomechanical pulping using various species of white-rot fungi compared to mechanical pulping without inoculation. Surprisingly, when eucalyptus wood chips were inoculated with *Ceriporiopsis subvermispora*, as described in the Examples below, substantial improvements in paper strength properties (burst index 70% and tear index 184%) were observed (see Table 3, below).

TABLE 1

Biomechanical pulping of pine (softwood) chips with several white-rot fungi and strains (2-week treatment).

| Fungi/strain | % improvements over control | |
|---|---|---|
| | Burst index | Tear index |
| *Phlebia brevispora* HHB-7099 | 0 | 13 |
| *Phlebia subserialis* RLG 6074-sp | 37 | 44 |
| *Dichomitus squalens* MMB 10963-sp | 13 | 41 |
| *Hyphodontia setulosa* FP 106976 | 0 | 40 |
| *Perenniporia medulla-panis* HHB 12172 | 24 | 34 |
| *Ceriporiopsis subvermispora* CZ-3 | 0 | 14 |
| *Ceriporiopsis subvermispora* FP-105752 SS-4 | 0 | 14 |
| *Ceriporiopsis subvermispora* L-14807 SS-1 | 0 | 14 |
| *Ceriporiopsis subvermispora* L-14807 SS-3 | 0 | 21 |
| *Ceriporiopsis subvermispora* L-14807 SS-5 | 0 | 21 |
| *Ceriporiopsis subvermispora* L-14807 SS-10 | 0 | 11 |

TABLE 2

Biomechanical pulping of aspen (hardwood) chips with several white-rot fungi and strains (2-week treatment).

| Fungi/strain | % improvement over control | |
|---|---|---|
| | Burst index | Tear index |
| *Phlebia subserialis* RLG 6074-sp | 0 | 0 |
| *Hyphodontia setulosa* FP 106976 | 0 | 0 |
| *Phlebia brevispora* HHB 7099 | 0 | 19 |
| *Phlebia tremelosa* FP 102557-sp | 0 | 24 |
| *Ceriporiopsis subvermispora* L-14807 SS-3 | 0 | 11 |

TABLE 3

Biomechanical pulping of *Eucalyptus grandis (hardwood)* chips with *Ceriporiopsis subvermispora* L-14807 SS-3 (2-week treatment).

| % improvement over control | |
|---|---|
| Burst index | Tear index |
| 70 | 184 |

Previous data with both hardwood and softwood species, including the data summarized in Tables 1 and 2, above, show strength improvements with fungus-treated chips compared to the control. However, these improvements are not as pronounced as those obtained during biomechanical pulping of eucalyptus wood chips, shown in Table 3 and in the Examples below. Eucalyptus is a hardwood species with poor paper strength, due to short fiber length. Because of its poor paper strength properties, this wood has traditionally been considered to be of only limited use in the production of pulp utilized in mechanical pulping processes. Therefore, traditionally, in the final furnish from which newsprint and tissue paper is produced, a significant amount of kraft pulp (about 50%) is mixed with eucalyptus mechanical pulp to impart strength. Biomechanical pulping of eucalyptus wood according to the process of the present invention results in such a substantial increase in fiber strength that it is possible to significantly reduce the amount of kraft pulp required for a final furnish.

Biomechanical eucalyptus pulp behave more like a softwood mechanical pulp, with the strength characteristics of such a pulp, than it behaves like a traditional hardwood pulp. These highly unexpected results have only been observed with only eucalyptus wood. We have evaluated other types of hardwood in the past, but never achieved such improvements in paper strength properties.

Details of the process of the present invention will become more apparent from the following examples which illustrate laboratory-scale embodiments on of the process of the present invention, and results achieved thereby.

EXAMPLES

Example 1

Biomechanical Pulping of Eucalyptus Wood

Eucalyptus wood chips were supplied by a mechanical pulp mill in Brazil. Chips were placed in plastic bags and frozen to prevent the growth of contaminating microorganisms.

Bioreactors containing 1.5 kg of chips (dry weight basis) were steam sterilized for 10 min. prior to inoculation. After cooling at room temperature, these chips were inoculated with a suspension containing, water, unsterilized corn steep liquor and fungus. The inoculated bioreactors were incubated for 2 weeks at 27° C. and 65% relative humidity. The control and fungus-treated wood chips were refined to a pulp and then used to produce paper. The chips were heat treated with steam pressurized to 15 p.s.i.g. for 1 minute and 15 seconds. During this time, the chips were sent through a thermo-mechanical refiner (Sprout-Bauer, model # 1210P, having a plate pattern D2B505, and 300-mm diameter) for fiberization. The pulp produced was subsequently fiberized in a Sprout-Waldron Model D2202 single rotating 300 mm diameter disk atmospheric refiner. Pulp was collected at each pass as hot water slurry. Between the passes the pulp slurry was dewatered to approximately 25% solids in a porous bag by vacuum. Dilution water at 85° C. was then added each time as the pulp was fed into the refiner. Samples of the pulp were taken and tested for the Canadian Standard Freeness (CSF) and the process continued until the samples were refined to 300–500 CSF. Hand sheets were also prepared and tested using TAPPI standard testing methods.

Fungal pretreatment of eucalyptus wood chips was found to enhance paper strength properties substantially compared to the untreated control (see Table 4, below). The fungal pretreatment increased burst index by 70%, tear index by 184%, tensile strength by 120% and breaking length by 120% compared to the control.

TABLE 4

Paper strength properties comparison.

| Strength properties | Control (untreated) chips | Fungus-treated chips |
|---|---|---|
| Freeness (ml) | 402 | 390 |
| Burst index (kN/g) | 0.20 | 0.34 |
| Tear index (mNm2/g) | 1.03 | 2.93 |
| Tensile strength (Nm/g) | 5.16 | 11.35 |
| Breaking length (m) | 526 | 1157 |

The results summarized above indicated that the treated mechanically processed fibers were stronger than conventional mechanical fibers.

Example 2

Replacement of 30% Kraft Pulp in a 50/50 Mechanica/Kraft Pulp

Most paper is generally produced from a furnish which is a combination of mechanical and chemical pulp, such as kraft pulp. Kraft pulp fibers are generally included in most papers because of their high strength and low lignin content. Unfortunately, kraft pulp fibers are expensive to produce. Kraft pulp is mixed with mechanical pulp to cut down on costs of production. However, there is generally a limit to what proportion of a pulp can comprise mechanical pulp fibers, without compromising the quality of the paper produced therefrom.

In this Example, paper produced from untreated pulp samples consisting of 50% mechanical fibers plus 50% hardwood bleached kraft pulp fibers was compared to paper produced from fungus-treated pulp samples consisting of 80% biomechanical fibers plus 20% hardwood bleached kraft pulp fibers. The results of this study are summarized in Table 5, below. These results clearly indicate that at least 30% of the expensive kraft fibers in a 50/50 mix of mechanical/kraft pulp can be substituted with biomechanical pulp fibers, which are significantly less expensive than kraft pulp. The hardwood bleached kraft pulp fibers were 100% hardwood, commercial grade, and were produced by a paper mill in Brazil.

TABLE 5

Kraft substitution studies with pulp samples.

| Strength properties | Control (untreated) chips[a] | Fungus-treated chips[b] |
|---|---|---|
| Burst index (kN/g) | 0.35 | 0.38 |
| Tear index ($mNm^2/g$) | 1.69 | 2.92 |
| Tensile strength (Nm/g) | 9.40 | 11.26 |
| Breaking length (m) | 959 | 1148 |
| Density ($kg/m^3$) | 310 | 307 |
| Specific volume ($cm^3/g$) | 3.23 | 3.26 |
| Drainage time (second) | 5 | 5 |

[a]50% TMP + 50% hardwood bleached kraft pulp.
[b]80% Bio-TMP + 20% hardwood bleached kraft pulp.

Example 3

Replacement of 40% Kraft Pulp in a 50/50 Mechanica/Kraft Pulp

Eucalyptus wood was pulped in separate portions as described in Examples 1–2, using mechanical or biomechanical pulping techniques. Paper was produced from a furnish of an untreated pulp of 50% mechanical pulp, 40% hardwood bleached kraft pulp, and 10% softwood kraft pulp was prepared as a control, above. Paper was also produced from a furnish of treated pulp of 90% biomechanical ecucalyptus fibers and 10% softwood fungus-treated kraft pulp, and compared to paper produced from the control pulp. The results of this study are presented in Table 6, below.

TABLE 6

Kraft substitution studies with pulp samples.

| Strength properties | Control (untreated) chips[a] | Fungus-treated chips[b] |
|---|---|---|
| Burst index (kN/g) | 0.35 | 0.68 |
| Tear index ($mNm^2/g$) | 2.50 | 3.83 |
| Tensile strength (Nm/g) | 9.41 | 14.50 |
| Breaking length (m) | 960 | 1476 |
| Specific volume ($cm^3/g$) | 3.02 | 3.17 |

[a]50% TMP + 40% hardwood bleached kraft + 10% softwood kraft pulp.
[b]90% Bio-TMP + 0% hardwood bleached kraft + 10% softwood kraft pulp.

The results of this study suggest the possibility of replacing even 40% hardwood bleached kraft pulp with biomechanical fibers in a blend containing 50% kraft pulp fibers.

We claim:

1. A biomechanical method of making a wood pulp from eucalyptus wood comprising the steps of:

(a) providing eucalyptus wood chips in a bioreactor;

(b) inoculating the wood chips with an inoculum including a viable culture of *Ceriporiopsis subvermispora;*

(c) incubating the wood chips under conditions favoring the propagation of the fungus through the wood chips for a sufficient amount of time for the fungus to modify a significant amount of the lignin naturally present in the wood chips; and (d) mechanically pulping the wood chips degraded by the fungus into a paper pulp.

2. The method of claim 1, wherein the culture of *Ceriporiopsis subvermispora* is a culture of *Ceriporiopsis subvermispora* L-14807 SS-3.

3. The method of claim 1 which includes the further step of bleaching of the paper pulp by a known multistage bleaching process.

4. The method of claim 1 wherein the incubation step is a static incubation step.

5. The method of 1 wherein *Ceriporiopsis subvermispora*is a strain selected from the group consisting of L-14807-SS-3, CZ-3, FP-105752-SS-5, FP-10572 and L-9186-SP.

6. The method of claim 1 wherein the wood chips are inoculated with the fungus and known nutrients.

7. The method of claim 1 wherein moisture content of the wood chips prior to the step of inoculation is kept at fiber saturation point or greater.

8. The method of claim 1 wherein said moisture content is 50–55% of the total wood based on a wet weight of the chips.

9. The method of claim 1 wherein the wood chips are inoculated with 1 to 5 gms inoculum/ton of wood.

10. The method of claim 1 wherein moisture content in the wood during the step of incubation is 55–65%.

11. A method of making a wood pulp from eucalyptus wood comprising the steps of:

(a) chipping eucalyptus wood into wood chips;

(b) introducing the wood chips into a bioreactor;

(c) inoculating the wood chips with an inoculum including a viable culture of a white rot fungus;

(d) incubating the wood chips under conditions favoring the propagation of the fungus through the wood chips for a sufficient amount of time for the fungus to modify a significant amount of the lignin naturally present in the wood chips; and (e) mechanically pulping the wood chips degraded by the fungus into a paper pulp.

12. The method of claim 11 wherein said white rot fungus is *Hyphodontia setulosa*.

13. The method of claim 11 wherein said white rot fungus is *Phlebia subserialis*.

14. The method of claim 11 wherein said white rot fungus is *Phlebia brevispora*.

15. The method of claim 11 wherein said white rot fungus is *Phlebia tremellosa*.

16. The method of claim 11 wherein said white rot fungus is *Phanerochaete chrysosporium*.

17. A method for producing paper comprising the steps of:

(a) introducing eucalyptus wood chips into a reactor;

(b) inoculating the wood chips in the reactor with a starter inoculum of the fungus *Ceriporiopsis subvermispora;*

(c) incubating the wood chips under conditions favorable to the propagation of the fungus through the wood chips;

(d) mechanically pulping the incubated wood chips to a selected level of freeness of fibers in the pulp; and (e) making paper with the pulp so produced.

18. The method of claim 17, wherein the culture of *Ceriporiopsis subvermispora* is a culture of *Ceriporiopsis subvermispora* L-14807 SS-3.

19. A method for producing paper comprising the steps of:

(a) introducing eucalyptus wood chips into a reactor;

(b) inoculating the wood chips in the reactor with a starter inoculum of the fungus *Ceriporiopsis subvermispora;*

(c) incubating the wood chips under conditions favorable to the propagation of the fungus through the wood chips;

(d) mechanically pulping the incubated wood chips to a selected level of freeness of fibers in the pulp; and (e) making paper with the pulp produced, the paper having at least a 70% improvement in burst index, and at least a 184% improvement in tear index over paper produced by a mechanical pulping of eucalyptus wood without inoculation of *Ceriporiopsis subvermispora*.

20. A method for producing paper comprising the steps of:

(a) introducing eucalyptus wood chips into a reactor;

(b) inoculating the wood chips in the reactor with a starter inoculum of the fungus *Ceriporiopsis subvermispora;*

(c) incubating the wood chips under conditions favorable to the propagation of the fungus through the wood chips;

(d) mechanically pulping the incubated wood chips to a selected level of freeness of fibers in the pulp; and (e) making paper with 80% of the eucalyptus pulp so produced and 20% of hardwood bleached kraft pulp.

21. A method for producing paper comprising the steps of:

(a) introducing eucalyptus wood chips into a reactor;

(b) inoculating the wood chips in the reactor with a starter inoculum of the fungus *Ceriporiopsis subvermispora;*

(c) incubating the wood chips under conditions favorable to the propagation of the fungus through the wood chips;

(d) mechanically pulping the incubated wood chips to a selected level of freeness of fibers in the pulp; and (e) making paper with 90% of the eucalyptus pulp so produced and 10% of softwood fungus treated kraft pulp.

22. A method of producing paper comprising the steps of:

(a) chipping eucalyptus wood into wood chips (b) heating the wood chips by steam elevating the surface temperature of the wood; chips to about 90° C. to about 100° C. in a chamber having open space of about 10% to about 65% of volume capacity;

(c) cooling the wood chips to a temperature between about 40° C. to about 45° C.;

(d) inoculating the wood chips by a liquid spray of an innoculum including a viable culture of *Ceriporiopsis subvermispora* L-14807 SS-3;

(e) incubating the wood chips under conditions favorable to the propagation of the fungus through the wood chips;

(f) mechanically pulping the incubated wood chips to a selected level of freeness of fibers in the pulp; and (g) making paper with the pulp produced, the paper having at least a 70% improvement in burst index, and at least a 184% improvement in tear index over paper produced by a mechanical pulping of eucalyptus wood without inoculation of *Ceriporiopsis subvermispora*.

* * * * *